United States Patent [19]

Braun et al.

[11] Patent Number: 4,460,335

[45] Date of Patent: Jul. 17, 1984

[54] SYSTEM FOR PREVENTING EXCESS PRESSURE IN A GAP BETWEEN A DOUBLE-SHELL STRUCTURE OF A BLAST HEATING APPARATUS

[75] Inventors: Kurt Braun, Stadecken-Elsheim; Friedrich Eschmann, Ginsheim-Gustavsburg, both of Fed. Rep. of Germany

[73] Assignee: Didier-Werke AG, Wiesbaden, Fed. Rep. of Germany

[21] Appl. No.: 492,005

[22] Filed: May 5, 1983

[30] Foreign Application Priority Data

May 14, 1982 [DE] Fed. Rep. of Germany ..... 3218127

[51] Int. Cl.[3] ..... F24B 14/08

[52] U.S. Cl. ..... 432/247; 432/217; 432/216; 432/30; 432/248; 110/336

[58] Field of Search ..... 432/247, 248, 251, 252, 432/30, 28, 40, 216, 217; 110/336, 340

[56] References Cited

U.S. PATENT DOCUMENTS

| | | | |
|---|---|---|---|
| 692,678 | 2/1902 | Koelkebeck | 432/216 |
| 1,421,256 | 6/1922 | Kling | 432/217 |
| 1,461,357 | 7/1923 | Kling | 432/217 |
| 1,771,306 | 7/1930 | Nelson | 432/217 |
| 2,187,191 | 1/1940 | Younglove | 432/217 |
| 2,272,108 | 2/1942 | Bradley | 432/217 |
| 2,478,293 | 8/1949 | MacDonald | 432/217 |
| 3,204,939 | 9/1965 | Ipsen | 432/251 |
| 4,005,982 | 2/1977 | Palz et al. | 432/248 |
| 4,022,573 | 5/1977 | Kuntziger | 432/30 |
| 4,290,751 | 9/1981 | Malone et al. | 432/217 |

*Primary Examiner*—Henry C. Yuen

*Attorney, Agent, or Firm*—Wenderoth, Lind & Ponack

[57] ABSTRACT

A blast heating apparatus includes an inner metal shell and an outer metal shell defining therebetween a gap filled with at least one pourable dry material, for example a mixture of SiC and graphite. To prevent excess pressure in the gap and to prevent condensate from entering the gap and attacking the outer shell, a piping system connects the gap to an area below the grate chamber of the blast heating apparatus.

4 Claims, 3 Drawing Figures

SYSTEM FOR PREVENTING EXCESS PRESSURE IN A GAP BETWEEN A DOUBLE-SHELL STRUCTURE OF A BLAST HEATING APPARATUS

BACKGROUND OF THE INVENTION

The present invention is directed to a system and apparatus for preventing excess pressure in a gap between inner and outer metal shells of double-shell structure of a blast heating apparatus.

In Eschmann et al. U.S. patent application Ser. No. 492,001, filed May 5, 1983, entitled "Blast Heating Apparatus for Blast Furnaces", filed concurrently with the present application, and assigned to the Assignee of the present application, there is disclosed a blast heating apparatus, particularly for blast furnaces, of the type including an inner metal shell having therein a refractory lining. Such inner metal shell and refractory lining are subject to failure during use, and to protect against such failure and to increase the life of the blast heating apparatus, such Eschmann et al. application provides an arrangement whereby an outer metal shell surrounds at least a portion of the inner metal shell and defines therewith a double shell structure. Spacers are positioned between the outer and inner metal sheels to define therebetween a gap. At least a portion of such gap is filled with a pourable dry material having a particular grain size and a particular heat conductivity. An acidproof coating having an epoxy resin base may be provided on the inside surface of the outer metal shell. The outer metal shell is formed of plural metal members joined at welded seams, and welding strips cover inner portions of the welded seams. Portions of the gap adjacent the welded seams are filled with an acidproof casting mass having an epoxy resin base and covering the welding strips. The welded seams generally include horizontal welded seams and vertical welded seams. With regard to the vertical welded seams, the spacers are positioned to extend vertically on opposite lateral sides of the vertical welded seams, with the casting mass being cast into portions of the gap between adjacent spacers. This structure avoids tension crack corrosion, prolongs the life of the blast heating apparatus, and readily can be incorporated into an existing blast heating apparatus.

It has been discovered however that during operation of such apparatus, surplus pressure can develop in the gap between the inner and outer metal shells, even when the old or inner metal shell is not damaged. Thus, in the event that the refractory fireproof brickwork lining within the inner metal shell becomes damaged, there will be increased temperatures at the inner shell, and thereby in the gap. It has been determined that when such situation occurs, such increased gap temperatures may lead to a decomposition of the plastic or epoxy resin casting mass or backfilling material. Such decomposition will lead to a buildup of excess pressure within the gap.

SUMMARY OF THE INVENTION

With the above discussion in mind, it is the object of the present invention to provide an improvement in the blast heating apparatus of the Eschmann et al. application, whereby it is possible to prevent such buildup of excess pressure in the gap between the inner and outer metal shells.

It is a further object of the present invention to provide such an improvement whereby it is possible to avoid a corrosive condensate attack on the new or outer metal shell.

The entire disclosure of the above mentioned Eschmann et al. application hereby is incorporated by reference into the present application.

The above objects are achieved in accordance with the present invention by the provision of a piping system for connecting the gap between the inner and outer metal shells to an area of the blast heating apparatus below the grate chamber. In this way, excess pressure which might develop as a result of decomposition of the plastic or epoxy resin material within the gap, upon the occurrence therein of increased temperatures, and which may endanger the inner metal shell, cannot occur. Due to the connection of the gap between the inner and outer shells with the area below the grate chamber, the pressure in the gap always is larger by an amount of the pressure loss on the blast side of the blast heating apparatus, approximately 500 to 700 mm b.s., than the pressure in the combustion chamber. This means that even should cracks subsequently occur in the inner shell, no damaging condensate can reach, or at least remain in, the gap and thereby attack the outer shell. This pressure equalizing system further means that even during normal operation of the blast heating apparatus, a synchronous pressure buildup in the gap and in the interior of the blast heating apparatus is guaranteed during the discharge phase. During the relatively short discharge operation, i.e. approximately 100 seconds, of the blast heating apparatus, the blast pressure readily can escape from the gap. Thereby, the older or inner shell is not stressed by exterior pressure.

In the preferred arrangement of the Eschmann et al. invention, the outer shell is formed of plural metal members jointed at welded seams, and the casting mass having the epoxy resin base is cast into those portions of the gap to cover the welded seams. This inherently divides the gap into individual double-shell gap chambers, each of which is filled with the dry pourable material. In accordance with a further feature of the present invention, the piping system connects each of these individual gap chambers with each other and with the area below the grate chamber. This will prevent the buildup of pressure in the individual gap chambers due to a pressure balancing of all of the gap chambers.

The reduction in pressure always takes place at a slight time delay to the pressure reduction in the interior of the blast heating apparatus. Accordingly, even if the old or inner metal shell should develop cracks or leakage, the entrance of corrosive agents into the gap is prevented.

In accordance with a further advantageous feature of the present invention, the upward blowing of dust particles of the dry pourable material in the gap during discharge operations is prevented. This is achieved by the provision that the piping system includes jet-like outlet pipes, each such outlet pipe extending through the outer shell and opening into the gap, or into an individual respective gap chamber. The provision of a suitable jet shape to each such outlet pipe, in connection with suitable positioning of the outlet pipes, makes it possible to control effectively the flow speed from the gap or gap chambers.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

Figure 1:
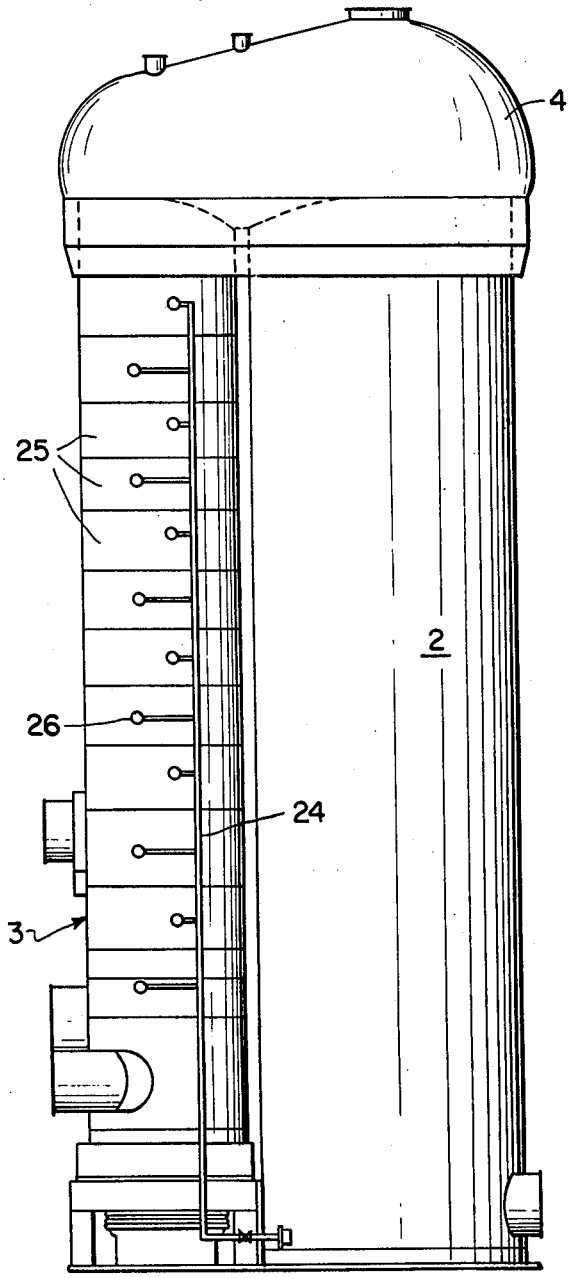
FIG. 1 is a somewhat schematic view of a blast heating apparatus constructed in accordance with the present invention.
Figure 3:
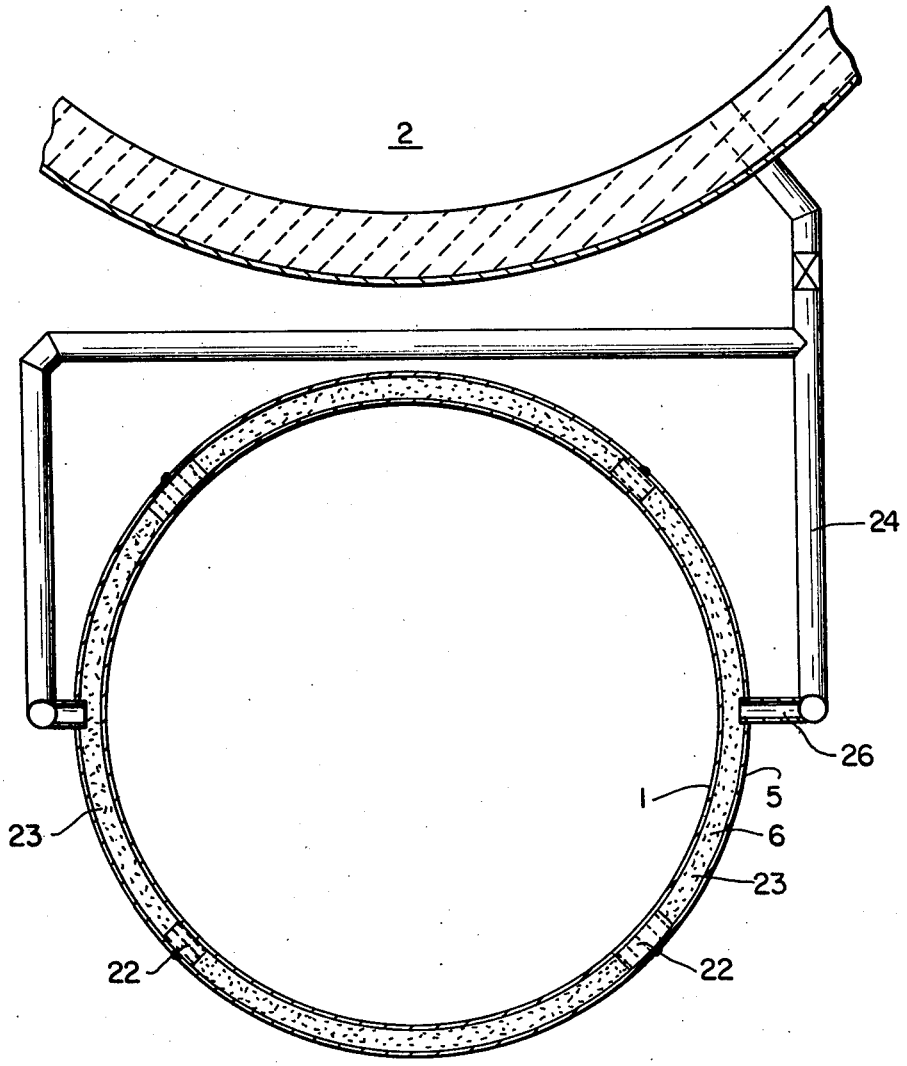
FIG. 3 is a somewhat schematic horizontal cross-sectional view from above the combustion chamber and a portion of the grate chamber with the interconnecting piping system according to the present invention.

With reference to the drawings, there is shown a blast heating apparatus, such as for a blast furnace, including a grate chamber 2, a combustion chamber 3, and a connecting dome 4, all of which are covered in a conventional manner by an inner metal shell 1 which is lined with a fireproof refractory lining. Such lining is shown only with regard to the grate chamber 2 in FIG. 3. In accordance with the above mentioned Eschmann et al. application, a portion of the blast heating apparatus, and specifically of the combustion chamber 3, includes an outer metal shell 5 surrounding the inner metal shell 1, with a gap 6 therebetween. As shown in FIG. 1, the outer metal shell 5 is formed of plural metal members connected by horizontal welded seams to form plural courses 25. Furthermore, as will be apparent from FIG. 3, the plural metal members also are joined by vertical seams. The construction of this double-shell structure is such that those portions of the gap adjacent the welded seams are filled with an acidproof casting mass having an epoxy resin base. Furthermore, welding strips may be provided to cover the inner portions of the welded seams. Spacers may be provided between the inner and outer shells to define a gap 6, and in a specific arrangement, which will be apparent from FIG. 3, the spacers are provided to extend vertically on opposite lateral sides of the vertical welded seams, with the casting mass being cast into the portions of the gap between adjacent such spacers. The provision of the casting mass along those portions of the gap at the horizontal and vertical welded seams divides the gap 6 into individual double-shell gap chambers which are filled with dry pourable material 23.

Should the refractory lining interiorly of inner shell fail at a particular location, increased temperatures will result, with the possibility of decomposition of the plastic material in the gap 6, thereby leading to a buildup of pressure in the gap.

This disadvantage however is overcome in accordance with the present invention by the provision of a piping system 24 connecting the gap 6 to an area of the blast heating apparatus below the grate chamber 2. This is apparent from a consideration of FIGS. 1 and 3. Furthermore, due to the specific connection of the gap 6 with the area below the grate chamber 2, the operation of the blast heating apparatus is not adversely affected, even should cracks or leakage occur in the inner metal shell 1. As will be apparent particularly from FIGS. 1 and 3 of the drawings, the piping system is such that the individual gap chambers, as defined by the casting mass, are connected with each other and with the area below grate chamber 2.

Figure 2:
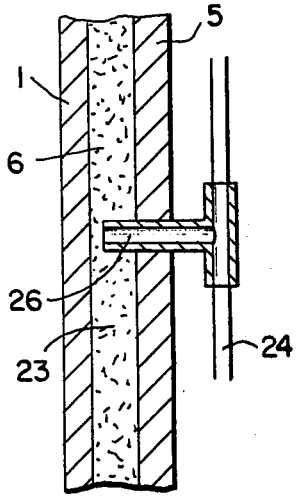
FIG. 2 is an enlarged cross-sectional view illustrating the double-shell structure and a jet-like outlet pipe extending into the gap thereof.

In accordance with a further feature of the present invention, as illustrated in FIG. 2, the piping system includes a plurality of jet-like outlet pipes 26, each of which extends through outer shell 5 and into a respective gap chamber. This provides the advantage discussed above.

Although the present invention has been described and illustrated with respect to preferred features thereof, it is to be understood that various modifications may be made to the specifically described and illustrated arrangement without departing from the scope of the present invention.

We claim:

1. In a blast heating apparatus of the type including an inner metal shell having therein a refractory lining, an outer metal shell surrounding at least a portion of said inner metal shell and defining therewith a double shell structure with a gap between said inner and outer shells, and a dry pourable material filling at least a portion of said gap, said blast heating apparatus further including a grate chamber, the improvement of means for preventing the buildup of excess pressure in said gap, said means comprising:

piping means for connecting said gap to an area of said blast heating apparatus below said grate chamber.

2. The improvement claimed in claim 1, wherein said outer shell is formed of plural metal members joined at welded seams covered inwardly by welding strips, and portions of said gap adjacent said welded seams are filled with an acidproof casting mass having an epoxy resin base and covering said welding strips, said casting mass dividing said gap into individual double-shell gap chambers filled with said dry pourable material, and said piping means comprises a piping system connecting said gap chambers with each other and with said area below said grate chamber.

3. The improvement claimed in claim 2, wherein said piping system includes plural jet-like outlet pipes, each extending through said outer shell and opening into a respective said gap chamber.

4. The improvement claimed in claim 1, wherein said piping means includes at least one jet-like outlet pipe extending through said outer shell and opening into said gap.

* * * * *